United States Patent [19]

Konieczynski et al.

[11] Patent Number: 4,925,101

[45] Date of Patent: May 15, 1990

[54] WAX SPRAY GUN AND NOZZLE

[75] Inventors: Ronald D. Konieczynski, North Royalton, Ohio; Jo Pintelon, Lennik, Belgium; Robert J. Holland, Avon, Ohio; C. Peter Barth, Avon Lake, Ohio; Jeff Gell, LaGrange, Ohio

[73] Assignee: Nordson Corporation, Westlake, Ohio

[21] Appl. No.: 237,714

[22] Filed: Aug. 26, 1988

[51] Int. Cl.[5] ..... B05B 7/10; B05B 1/26

[52] U.S. Cl. ..... 239/8; 239/124; 239/391; 239/405; 239/415; 239/519; 239/526

[58] Field of Search ..... 239/8, 398, 403, 405, 239/406, 468, 471, 135, 526, 112, 113, 124, 125, 390, 391, 396, 412, 415, 500, 501, 519; 285/317, 320

[56] References Cited

U.S. PATENT DOCUMENTS

| | | | |
|---|---|---|---|
| 1,346,750 | 7/1920 | Herman | 239/405 |
| 1,547,349 | 7/1925 | Reichenbach | 239/405 |
| 2,107,732 | 2/1938 | Gustafsson et al. | 239/412 |
| 2,161,235 | 6/1939 | Schlagintweit | 239/519 X |
| 2,585,429 | 2/1952 | Boe . | |
| 2,896,864 | 7/1959 | Jemison et al. | 239/519 X |
| 3,485,428 | 12/1969 | Jackson . | |
| 3,556,411 | 1/1971 | Nord et al. . | |
| 3,589,610 | 6/1971 | Wahlin | 239/125 |
| 3,658,255 | 4/1972 | Beall, Jr. | 239/415 |
| 3,716,190 | 2/1973 | Lindlof . | |
| 3,734,406 | 5/1973 | Runstadler, Jr. et al. . | |
| 3,764,069 | 10/1973 | Runstadler, Jr. et al. . | |
| 3,819,403 | 6/1974 | Hogstrom . | |
| 3,852,095 | 12/1974 | Hogstrom . | |
| 4,251,573 | 2/1981 | Holm et al. . | |
| 4,396,529 | 8/1983 | Price et al. . | |
| 4,458,719 | 7/1984 | Strybel | 285/320 X |
| 4,546,921 | 10/1985 | McCormack | 239/125 |
| 4,553,701 | 11/1985 | Rehman et al. . | |
| 4,630,774 | 12/1986 | Rehman et al. . | |
| 4,632,314 | 12/1986 | Smith et al. . | |
| 4,655,394 | 4/1987 | Ferrazza et al. . | |
| 4,664,314 | 5/1987 | O'Brien et al. . | |
| 4,692,358 | 9/1987 | Marsden et al. | 239/436 X |

FOREIGN PATENT DOCUMENTS

| | | | |
|---|---|---|---|
| 433365 | 5/1923 | Fed. Rep. of Germany | 239/403 |
| 2081606 | 2/1982 | United Kingdom . | |

OTHER PUBLICATIONS

Protect-O-Spray Airless Underbody Pumps and Accessories, The Aro Corporation, Bryan, Ohio 43506, two (2) pages.

Drawing No. 60938 from The Aro Corporation, 1 page.

*Primary Examiner*—Andres Kashnikow

*Assistant Examiner*—William Grant

*Attorney, Agent, or Firm*—Wood, Herron & Evans

[57] ABSTRACT

A wax spray gun and spray nozzle for discharging an atomized stream of molten wax onto a vehicle body component or other substrate comprises a gun body having an atomizing chamber within which an internal wax spray nozzle and atomizing cap are located. A stream of atomizing air is tangentially directed into the atomizing chamber to form a rotating, swirling stream of atomizing air which is accelerated through a venturi inlet formed in the atomizing cap to impact and thoroughly atomize molten wax discharged from the internal spray nozzle. The atomized stream of molten wax is then discharged from the gun body into an external nozzle which preferably comprises a nozzle body having a wall formed with external threads which carry a coil spring. A flat is formed in the wall of the nozzle body with a discharge opening therein over which at least two spaced spring wires are positioned in the path of atomized molten wax emitted from the discharge opening. The atomized molten wax contacts the spring wire and is further atomized and deflected in a diffuse pattern for deposition onto a substrate.

15 Claims, 4 Drawing Sheets

WAX SPRAY GUN AND NOZZLE

FIELD OF THE INVENTION

This invention relates to apparatus for spraying molten wax, and, more particularly, to a spray gun and improved nozzle for depositing an atomized stream of molten wax in a repeatable, uniform coating onto a surface such as the body components of a vehicle.

BACKGROUND OF THE INVENTION

It is common practice among vehicle manufacturers to apply wax or other protective coatings to the inner cavities of vehicle body components such as doors, rear deck and hatchback lids, hoods, fender panels, frame components and underbodies. The intent is to provide a uniform, uninterrupted coating of protective material on the inside surfaces of enclosed cavities as well as along the hem flange areas of such components and other areas where water and corrosive materials are most likely to collect.

In most vehicle assembly lines, protective coatings are currently applied to body components manually by an operator using a hand-held spray gun. Prior art hand-operated spray guns generally comprise a gun body formed with a wax delivery passageway connected to a nozzle having a discharge outlet. A plunger is mounted within the wax delivery passageway which is movable between an open and closed position to control the flow of molten wax through the gun body to the nozzle. Many wax spray guns incorporate one or more atomizing air passageways which direct atomizing air into contact with a stream of molten wax ejected from the discharge outlet of the nozzle so that the wax is atomized and deposited in droplet form onto vehicle body components or other substrates.

Prior art molten wax spray guns of the type described above have a number of disadvantages. In most designs, the molten wax is recirculated outside of the spray gun when the gun is not in use, e.g., through an exterior recirculation block connected to hoses leading to and from a heated tank or other source of molten wax. The wax located within the wax delivery passageway of the spray gun remains in place when the spray gun is turned off and is allowed to cool and form a cold slug of wax within the gun. In order to resume a spraying operation, this cold slug of wax must first be pushed outwardly through the wax delivery passageway and nozzle before the warm, molten wax can flow. As a result, the spray gun is exceedingly slow to "open", i.e., a relatively long time elapses once the trigger is depressed in order for the molten wax to displace the cold slug of wax within the spray gun and then move along the entire length of the wax delivery passageway in the gun to the discharge outlet of the nozzle where it is dispensed.

Another problem with prior art wax spray guns is that atomization of the molten wax is often incomplete. A solid stream of molten wax is ejected from the discharge outlet of the nozzle in the gun body which is impacted by one or more streams of atomizing air directed at the exterior of the stream. Due to the highly viscous nature of the molten wax, the atomizing air in prior art spray guns often fails to completely convert the solid stream of molten wax to droplet form before it reaches the vehicle body component or substrate to be coated. This can result in an uneven, nonuniform coating on the target and/or gaps in the coating.

A number of vehicle body components which must be coated are of irregular shape and include a number of crevices along their inner cavities. In addition, access openings for spraying such body components are often small and/or permit limited manipulation of the hand-held wax spray gun. As a result, nozzle attachments for wax spray guns have been designed to direct the flow of molten wax to the desired areas of the vehicle body component. In many instances, these nozzle attachments have been essentially hand made and usually include cylindrical tubes which are bent or pinched at various angles to obtain the desired coverage.

One problem with nozzle attachments of this type is that the coverage of coating material on a body component which is obtained from one nozzle attachment might not be repeated with another nozzle attachment, and thus there is no assurance that a coating of proper uniformity and coverage will be obtained after each spraying operation. In addition, it is often difficult to obtain the coverage desired because of space considerations, i.e., there may not be sufficient space to provide enough spray nozzles and accompanying atomizing air jets on a nozzle attachment to ensure the entire area to be coated receives a uniform wax coating.

SUMMARY OF THE INVENTION

It is therefore among the objectives of this invention to provide a spray gun and improved nozzle for spraying molten wax or other viscous liquids which ensures complete atomization of the liquid, which produces complete, uniform and repeatable coverage of the liquid on a given vehicle body component or other substrate, which is efficient in operation and which is economical to manufacture.

These objectives are accomplished in a spray gun and an improved nozzle for spraying molten wax or other viscous liquids which comprises a gun body formed with a wax supply passageway and an atomizing chamber. An airless spray nozzle is connected to the wax supply passageway and has a discharge outlet located in the atomizing chamber. Molten wax is delivered into the wax supply passageway of the gun body and is ejected through the discharge outlet of the airless spray nozzle toward the venturi inlet of an atomizing cap located in the atomizing chamber. A stream of atomizing air is transmitted into the atomizing chamber such that the atomizing air is directed in a swirling, vortex type motion toward the discharge outlet of the nozzle and the venturi inlet of the atomizing cap. The venturi inlet accelerates the swirling stream of atomizing air past the discharge outlet of the nozzle causing it to impact the molten wax at high velocity to effectively atomize the molten wax into droplet form. The atomized waxed stream is then discharged from the gun body into a spray nozzle located externally of the gun body for deposition onto a vehicle body component or other substrate.

One important feature of this invention is predicated upon the formation of a vortex-like, swirling stream of atomizing air within the atomizing chamber, and then accelerating that swirling stream into contact with the molten wax to ensure complete atomization of the molten wax. In the presently preferred embodiment, the discharge outlet of the airless nozzle carried within the atomizing chamber is positioned at the entrance to the venturi inlet of the atomizing cap. An atomizing air delivery passageway is formed in the gun body which extends between the atomizing chamber and a valve communicating with a source of atomizing air. The atomizing air passageway tangentially intersects the atomizing chamber, which is preferably cylindrical in shape, so that the atomizing air stream travels along the cylindrical inner wall of the atomizing chamber in a swirling motion.

The atomizing air stream swirls around the periphery of the nozzle within the atomizing chamber and flows to the venturi inlet of the atomizing cap therein. The venturi inlet substantially increases the spin velocity of the atomizing stream, i.e., its rotational or swirling velocity, so that the atomizing stream passes the nozzle and impacts the molten wax discharged therefrom at a substantial velocity to ensure substantially complete break up or atomization of the molten wax into droplet form. The atomized wax stream is then discharged from the atomizing cap to an external nozzle for deposition onto a surface.

Another important aspect of this invention is predicated upon obtaining complete, uniform and repeatable coverage of coating material onto a vehicle body component or other substrate. This is achieved in the instant invention by atomizing the molten wax within the interior of the spray gun and then discharging the atomized wax stream into an external spray nozzle having a configuration to ensure complete coverage of essentially any vehicle component to be coated.

In the presently preferred embodiment, a quick disconnect nozzle mount is releasably supported on an insert carried by the atomizing cap mounted to the gun body. This quick disconnect nozzle mount comprises a tube insertable through the insert into the passageway formed in the atomizing cap, and a spring-biased locking arm adapted to releasably mount in a slot or recess formed in the insert.

The quick disconnect nozzle mount, in turn, supports a number of different nozzle assemblies which are releasably mounted thereto by a nozzle adaptor. In one presently preferred embodiment, the nozzle assembly comprises a nozzle body having a central passageway which communicates with the tube of the quick disconnect nozzle mount for transmitting the stream of atomized molten wax from the atomizing cap. A number of individual spray nozzles are carried by the nozzle body and each connects to the central passageway of the nozzle body for spraying a separate stream of atomized molten wax. These individual spray nozzles are mounted at desired locations around the nozzle body to obtain complete and uniform coverage of coating material on a vehicle body component or other substrate. Because the molten wax is atomized within the spray gun, these external nozzles need not be of special design or incorporate atomizing air passageways as in prior art apparatus wherein atomization of the molten wax takes place outside of the spray gun.

In an alternative embodiment, a nozzle assembly is provided which releasably mounts to the nozzle adaptor carried by the quick disconnect nozzle mount. This nozzle assembly comprises a nozzle body having a passageway connected to the tube of the quick disconnect nozzle mount, and at least two radially outwardly extending hollow arms or tubes. Each arm or tube transmits atomized molten wax from the passageway of the nozzle body onto the substrate or vehicle body component to be coated. These radially outwardly tubes can be oriented at essentially any angle relative to the nozzle body to obtain the desired coverage of coating material on the object to be coated.

A still further embodiment of a nozzle assembly is disclosed herein which is adapted for spraying of atomized molten wax or essentially any other liquid material. This nozzle assembly comprises a nozzle body having a cylindrical-shaped wall defining a passageway for transmitting liquid. The wall is formed with external threads except for at least one section wherein the threads are removed such as by milling a flat area in the wall of the nozzle body. A discharge bore is formed in the wall of the nozzle body at this milled, flat area which emits the liquid transmitted through the passageway in the nozzle body.

In the presently preferred embodiment, a coil spring is threaded onto the outside of the wall of the nozzle body so that its spring wire is carried within the threads formed therein. Preferably, at least two sections of the spring wire carried within adjacent threads are positioned over the discharge bore in the flat area formed in the wall of the nozzle body. These sections of spring wire are spaced from one another in such flat area by the external threads, and are positioned directly in the path of liquid emitted from the discharge bore.

In the particular application where the nozzle assembly of this embodiment is employed to spray atomized molten wax, the sections of spring wire located over the discharge bore in the wall of the nozzle body are effective to impact the atomized wax stream and form a diffuse spray pattern onto a vehicle body component or other substrate. In addition, the rounded upper and lower surfaces of the sections of spring wire which contact the atomized molten wax tend to agitate and further atomize the wax as it passes through the space between the adjacent sections of spring wire. The degree of atomization and the type of spray pattern produced by the nozzle of this embodiment is variable depending upon the gauge or thickness of the spring wire employed, and also by the spacing between the wire sections located over the discharge bore in the nozzle wall which is governed by the space between adjacent threads formed on the outer surface of the nozzle body.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
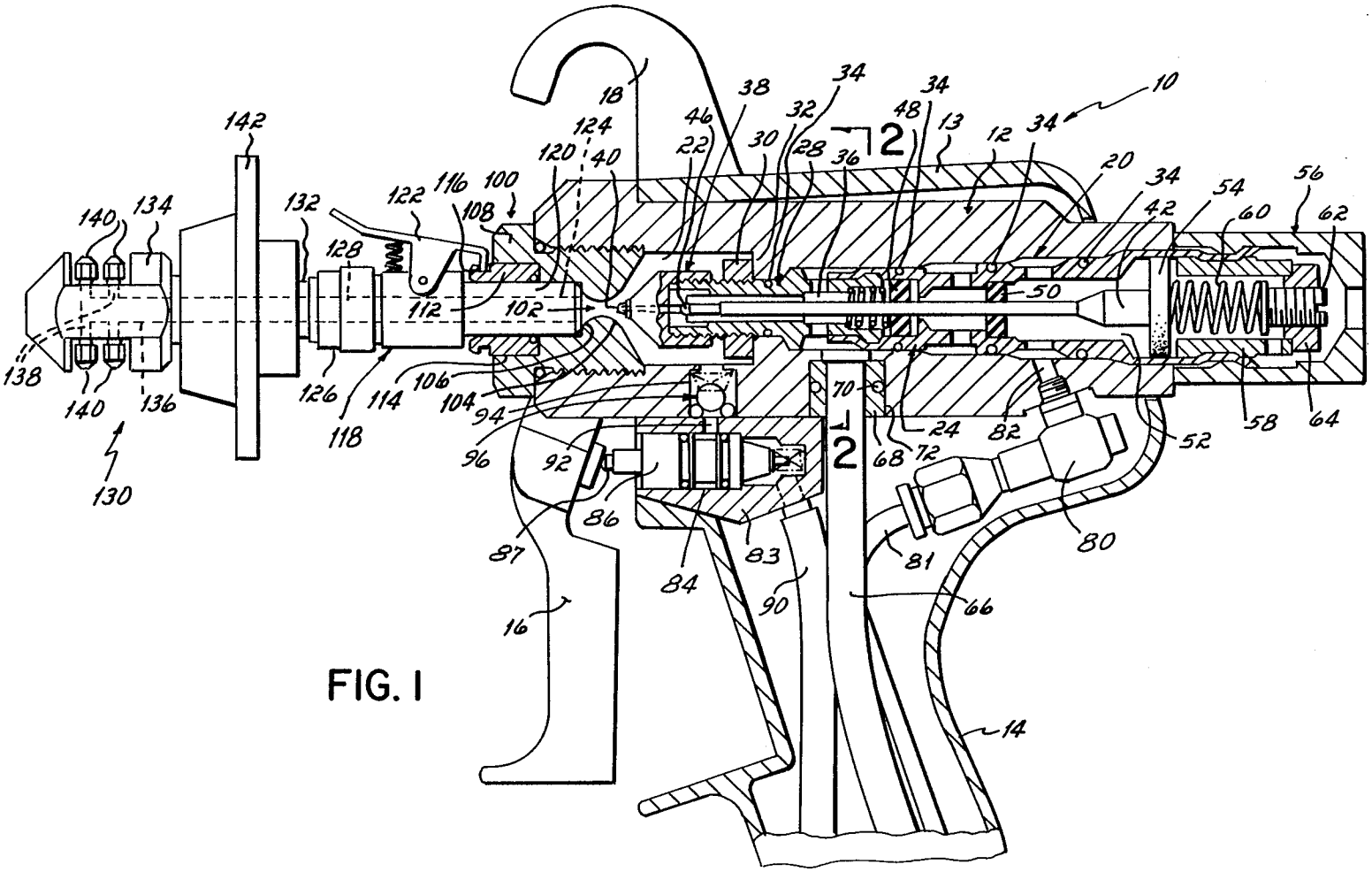
FIG. 1 is an elevational view in partial cross section of the wax spray gun of this invention with one embodiment of an external spray nozzle assembly.

Referring now to FIGS. 1-5, a wax spray gun 10 is illustrated which comprises a gun body 12, an outer housing 13 forming a handle 14, and a trigger 16 pivotally mounted to the gun body 12. The outer housing 13 is formed with a hook 18 to permit storage of the gun when not in use.

The gun body 12 is formed with a stepped central bore 20 which defines an atomizing chamber 22 at its forward end. The term "forward" as used herein refers to the downstream direction of flow through the gun body 12, i.e., the lefthand portion of the gun 10 as viewed in FIG. 1, while "rear" refers to the opposite end of the gun body 12. A sleeve 24 is carried within the bore 20 of gun body 12 which is connected at its forward end to a nozzle mount 28 having external threads. The nozzle mount 28 is secured in place within the gun body 12 by a nut 30 which is threaded onto the nozzle mount 28 and rests against a shoulder 32 formed in the gun body 12 at the entrance to the atomizing chamber 22. Preferably, both the sleeve 24 and nozzle mount 28 have O-rings 34 which engage the inner surface of the bore 20 in gun body 12 to create a fluid-tight seal therebetween.

The sleeve 24 is formed with a wax delivery passageway 36 which extends along the forward portion thereof and through the nozzle mount 28. The forward end of nozzle mount 28 carries an airless, internal nozzle 38 having a passageway 39 connected to the wax delivery passageway 36, and a discharge outlet 40 located within the interior of atomizing chamber 22. The internal nozzle 38 is operative to discharge a stream of molten wax into the atomizing chamber 22 through its discharge outlet 40, as described in more detail below.

The operation of internal nozzle 38 is controlled by a plunger 42 which extends axially along the length of sleeve 24. The forward end of plunger 42 has a tip 46 which is adapted to open or close the passageway 39 of internal nozzle 38 to control the flow of a molten wax therethrough. The rearward end of plunger 42 extends through a pair of seals 48, 50 and into a pilot air chamber 52 formed in the rearward portion of the sleeve 24. A plunger head 54 is carried at the rearward end of plunger 42 within the pilot air chamber 52 and the outer edges thereof seal against the inner wall of the sleeve 24.

A cap 56 is mounted to the rearward end of gun body 12 and a portion of the sleeve 24 is secured therein by a cylinder 58. A return spring 60 is carried within the cylinder 58 which is mounted at one end to the plunger head 54 and at the opposite end to an adjustment screw 62 movable within a nut 64 fixed to the cylinder 58. Rotation of the adjustment screw 62 relative to the nut 64 adjusts the tension applied by return spring 60 onto the plunger head 54 and plunger 42 for purposes described below.

Figure 2:
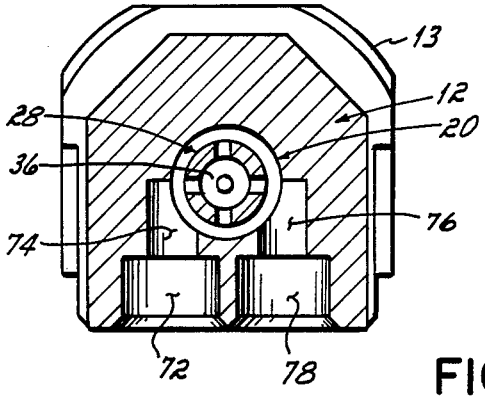
FIG. 2 is a cross sectional view of the wax recirculation passages taken generally along lines 2—2 of FIG. 1.

The flow of molten wax within the gun body 12 is obtained by the structure described above in the following manner. A wax delivery line 66 extends through the gun handle 14 and is carried in the gun body 12 by a mount 68 having an O-ring 70. As shown in FIG. 2, the inner end of wax delivery line 66 connects to a wax inlet 72 formed in gun body 12, which, in turn, is connected by a passage 74 to the wax delivery passageway 36 of sleeve 24. If the spray gun 10 is not being operated, the molten wax passes from the wax delivery passageway 36 in sleeve 24 through a passage 76 and a wax outlet 78 formed in gun body 12 to a return line (not shown) which carries the molten wax back to a heated tank or other container.

In FIG. 1, the plunger 42 has been moved to a closed position by return spring 60 so that the tip 46 of plunger 42 closes the passageway 39 of internal nozzle 38 and thus prevents the flow of wax from wax delivery passageway 36 into the internal nozzle 38. The molten wax is recirculated with the plunger 42 in this position, i.e., it flows through inlet 72, into passageway 36 and out the outlet 78 as described above, so that the wax within the gun body 12 remains molten.

In order to initiate the flow of molten wax through nozzle 38, a shuttle valve 80 connected to a pilot air line 81 within handle 14 is moved to an open position. The shuttle valve 80 allows pilot air to enter the pilot air chamber 52 in sleeve 24 through a passage 82 formed in the gun body 12. When the pilot air chamber 52 becomes pressurized, the plunger head 54 and plunger 42 are moved rearwardly, i.e., to the right in FIG. 1, which unseats the tip 46 of plunger 42 from the passage 39. This allows the molten wax within the wax delivery passageway 36 to flow through passageway 39 into the internal nozzle 38 where it is ejected from the discharge outlet 40 of nozzle 38 into the atomizing chamber 22. When the shuttle valve 80 is closed, the flow of pilot air through pilot air line 81 is terminated and the air within pilot air chamber 52 is allowed to bleed back in the opposite direction through the shuttle valve 80. This depressurizes the pilot air chamber 52 and permits the return spring 60 to force the plunger 42 forwardly so that its tip 46 closes the passageway 39 to nozzle 38 and thus stops the flow of wax therethrough.

The above described structure for delivering molten wax into the atomizing chamber 22 of gun body 12 is combined and synchronized with the supply of atomizing air to the atomizing chamber 22. In the embodiment illustrated in FIG. 1, the supply of atomizing air is controlled by the following structure.

The handle 14 carries a support 83 having a bore 84 which mounts an air valve 86 having an operating plunger 87. The bore 84 is connected to a source of atomizing air by a supply line 90 extending through the gun handle 14. A passage 92 interconnects the bore 84 with a swirl passageway 94 formed in the gun body 12. A one-way valve 96 is mounted within the swirl passageway 94 at the entrance to passage 92 so as to permit flow of atomizing air into the swirl passageway 94 but prevent flow in the opposite direction.

Figure 4:
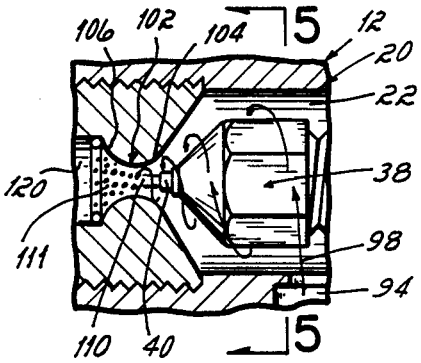
FIG. 4 is an enlarged view of the atomizing cap and atomizing chamber shown in FIG. 1.
Figure 5:
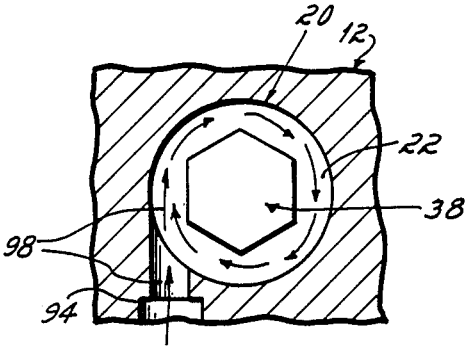
FIG. 5 is a cross sectional view of the atomizing chamber taken generally along lines 5—5 of FIG. 4.

As best shown in FIG. 5, the inner end of swirl passageway 94 tangentially intersects the atomizing chamber 22 which is preferably cylindrical in shape. When the air valve 86 is moved to an open position by depressing trigger 16, atomizing air passes from supply line 90, through bore 84 and passage 92 into the swirl passageway 94. The atomizing air is directed from swirl passageway 94 along the cylindrical-shaped wall of atomizing chamber 22 to induce a swirling or rotational movement of the atomizing air within atomizing chamber 22. As shown in FIGS. 4 and 5, a rotating or swirling stream of atomizing air 98 flows around the internal nozzle 38 and moves toward its discharge outlet 40.

In the presently preferred embodiment, an atomizing cap 100 is threaded into the forward end of gun body 12 within the atomizing chamber 22. As shown in FIGS. 1 and 4, the atomizing cap 100 is formed with a passageway 102 having a venturi inlet 104 and an outlet 106. The outermost end of atomizing cap 100 has a head 108 which rests against the forward end of gun body 12.

Referring to FIG. 4, the swirling atomizing air stream 98 within atomizing chamber 22 flows to the venturi inlet 104 of atomizing cap 100. This venturi inlet 104 is effective to accelerate the swirling motion of the atomizing air stream 98 past the discharge outlet 40 of internal nozzle 38. In other words, the swirl or rotational velocity of the atomizing air stream 98 increases in moving through the venturi inlet 104 of atomizing cap 100 so that the resultant velocity of the atomizing air stream 98 substantially increases at the discharge outlet 40 of internal nozzle 38. The atomizing air stream 98 impacts a stream 110 of molten wax discharged from the nozzle 38 into passageway 102 of atomizing cap 100 and breaks up or atomizes the molten wax stream 110 into droplets 111 which are discharged from the atomizing cap 100 through its outlet 106.

In the embodiment of FIG. 1, the flow of atomizing air and molten wax are automatically synchronized and controlled with a commercially available, programmable controller (not shown) which forms no part of this invention per se and is thus not described herein. When the trigger 16 is depressed, the air valve 86 is moved to an open position thus permitting the flow of atomizing air from supply line 90 into the atomizing chamber 22 as described above. A flow switch (not shown) senses the presence of atomizing air in the course of its movement into atomizing chamber 22 and sends a signal to the controller. The controller sends a signal to move the shuttle valve 80 to an open position which, as described above, supplies pilot air into the pilot air chamber 52 to move plunger 42 to an open position.

The operator is instructed to maintain the trigger 16 in a depressed position throughout the duration of a spraying operation. The controller automatically closes the shuttle valve 80 after a predetermined amount of time has elapsed so that the plunger 42 is returned to a closed position to stop the flow of molten wax through internal nozzle 38 as described above. Once the flow of wax has stopped, the operator releases trigger 16 to move air valve 86 to a closed position and therefore stop the flow of atomizing air through gun 10. In this manner, a predetermined quantity of molten wax is discharged from the gun 10 so that an area to be coated receives the appropriate coverage of wax without waste.

Figures 10, 11:
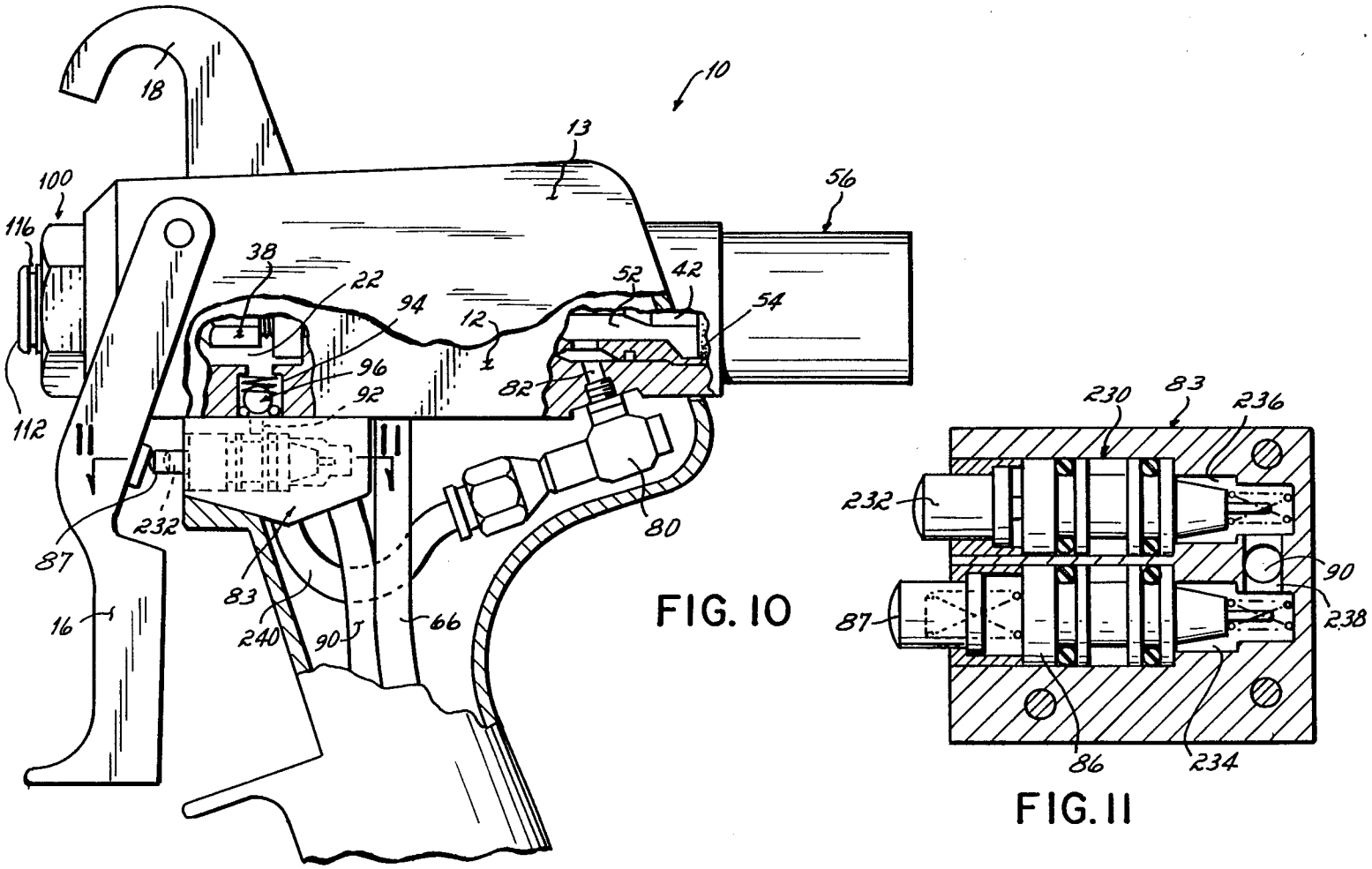
FIG. 10 is a view similar to FIG. 1, in partial cross section, illustrating an alternative embodiment of the pilot air supply to the pilot air chamber of the plunger.
FIG. 11 is a cross sectional view taken generally along lines 11—11 of FIG. 10.

In an alternative embodiment shown in FIGS. 10 and 11, the spray gun 10 is converted from automatic to manual operation. A second air valve 230 is carried in the support 83, alongside of the air valve 86, which has an operating plunger 232 located closer to the handle 14 than the operating plunger 87 of air valve 86. The air valves 86, 230 are located in separate chambers 234, 236, respectively, formed in support 83. The chambers are interconnected by a passage 238, which, in turn, is connected to a source of pressurized air by supply line 90. The chamber 234 of valve 86 is connected to the passage 92 which leads to atomizing chamber 22 as described above in connection with FIG. 1. The chamber 236 of air valve 230 is connected by a line 240 located within handle 14 to the shuttle valve 80. The remaining structure of the spray gun 10 of this embodiment is identical to that of FIG. 1.

The operation of the spray gun 10 of this embodiment is as follows. When the trigger 16 is depressed, it first contacts the operating plunger 87 of air valve 86 which opens the air valve 86 to permit the flow of pressurized air to pass through its chamber 234, into passage 92 and then to atomizing chamber 22 as described above. As the trigger 16 continues to move rearwardly toward handle 14, the operating plunger 232 of second air valve 230 is contacted to open second air valve 230 and permit pressurized air from supply line 90 to flow through chamber 236 of air valve 230 and then to enter line 240. The pressurized air passes through line 240 and the shuttle valve 80, and then flows into the pilot air chamber 52 to move the plunger 42 to an open position which begins the flow of wax through nozzle 38 as described above. As a result of this sequential activation of air valves 86, 230, atomizing air is supplied to atomizing chamber 22 before the molten wax flows therein thus ensuring complete atomization of even the initial stream of wax discharged from spray gun 10.

The flow of atomized wax from spray gun 10 continues in the embodiment of FIGS. 10 and 11 as long as the operator maintains the trigger 16 depressed. In order to stop the flow of wax, the trigger 16 is released which sequentially terminates the flow of wax and then the atomizing air. Since the plunger 232 of air valve 230 is located closest to handle 14, the plunger 232 is released first by trigger 16 and returns to its initial, extended position to close valve 230. When the flow of pilot air through valve 230 to shuttle valve 80 is terminated, the air within pilot air chamber 52 quickly bleeds back through the shuttle valve 80 thus allowing return spring 60 to move the plunger 42 to a closed position as described above. As the trigger 16 continues moving outwardly from handle 14, the operating plunger 87 of air valve 86 is extended and closes air valve 86 to stop the flow of atomizing air into atomizing chamber 22 after the flow of wax therein has been terminated. This sequential termination of first the wax flow and then the atomizing air flow ensures that all of the molten wax at the end of the wax stream discharged from nozzle 38 is atomized and completely ejected from passageways 102 and 138.

Figure 3:
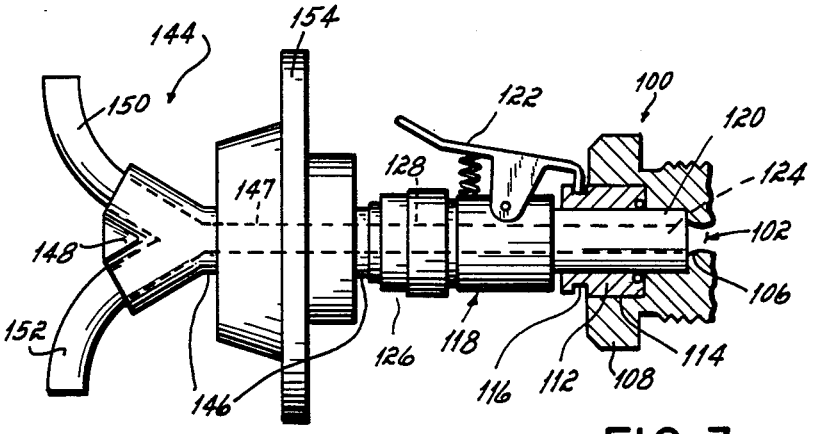
FIG. 3 is an alternative embodiment of a nozzle assembly herein.

Referring now to FIGS. 1 and 3, two alternative embodiments of an external spray nozzle assembly are illustrated both of which are adapted to mount to the wax spray gun 10. The structure for mounting such spray nozzle assemblies to the gun body 12 includes an insert 112 which is press fitted into a bore 114 formed in the head 108 of atomizing cap 100. This insert 112 has an outer end formed with a circumferentially extending recess or slot 116. A quick disconnect mount 118 is provided which includes a tube 120 insertable through the adaptor 112 into the atomizing cap 100, and a spring-biased locking arm 122 which is releasably connectable to the slot 116 in insert 112. The tube 120 is formed with a passageway 124 for transmitting atomized molten wax from the outlet 106 of atomizing cap 100 to the spray nozzle assemblies, as described below. The outer end of quick disconnect mount 118 supports a nozzle adaptor 126 formed with a passage 128.

Referring first to the embodiment of FIG. 1, a nozzle assembly 130 is illustrated which has a rearward end 132 adapted to thread into the nozzle adaptor 126. The nozzle assembly 130 comprises a nozzle body 134 having a central passageway 136 for transmitting atomized molten wax, and a number of discharge bores 138 which extend radially outwardly from the central passageway 136. Each of the discharge bores 138 mounts a separate spray nozzle 140 and these spray nozzles 140 are effective to spray atomized molten wax emitted through the discharge bores 138 of nozzle body 134. Preferably, a gauge piece 142 is carried at the rearward end of nozzle 134 between the spray nozzles 140 and the nozzle adaptor 126. This gauge piece 142 is formed to engage the wall of an access opening to a vehicle body component (not shown) and automatically align the spray nozzles 140 with the area to be coated so that the operator does not have to manipulate the spray gun 10. It is contemplated that gauge piece 142 would be formed in a variety of shapes and/or sizes to obtain the appropriate alignment of nozzles 140 depending upon the configuration of the access opening in the vehicle body component to be coated.

The nozzle assembly 130 includes a total of eight spray nozzles 140, four of which are shown in FIG. 1 (the remaining four are aligned directly below the four shown). It should be understood that essentially any number of spray nozzles 140 could be employed depending upon the spray pattern desired for a given application. Additionally, the position of the spray nozzles 140 about the circumference of nozzle body 134 is variable, as desired, depending upon where the discharge bores 138 are formed in a nozzle body 134.

An alternative embodiment of a nozzle assembly is illustrated in FIG. 3 which mounts to the quick disconnect mount 118 as in the embodiment of FIG. 1. The nozzle assembly 144 of FIG. 3 comprises a nozzle body 146 having a central passageway 147 and a forward end 148 which mounts a pair of radially outwardly extending, diametrically opposed spray tubes 150, 152. A gauge piece 154 is carried on the nozzle body 146 between the tubes 150, 152 and the nozzle adaptor 126. In this embodiment, two streams of atomized molten wax are ejected from the nozzle assembly 144, one through each of the tubes 150, 152, to obtain the desired coverage for a particular application. It is contemplated that the particular angular orientation of the tubes 150, 152, and/or the number or location of tubes 150, 152, could be varied as desired depending upon the spray pattern of atomized molten wax required.

Referring now to FIGS. 6–9, an alternative embodiment of a spray gun 156 and an improved nozzle 158 are illustrated. The spray gun 156 operates in essentially the same manner as spray gun 10 except it is actuated automatically by a programmable controller instead of by hand through the operation of a trigger.

Figure 6:
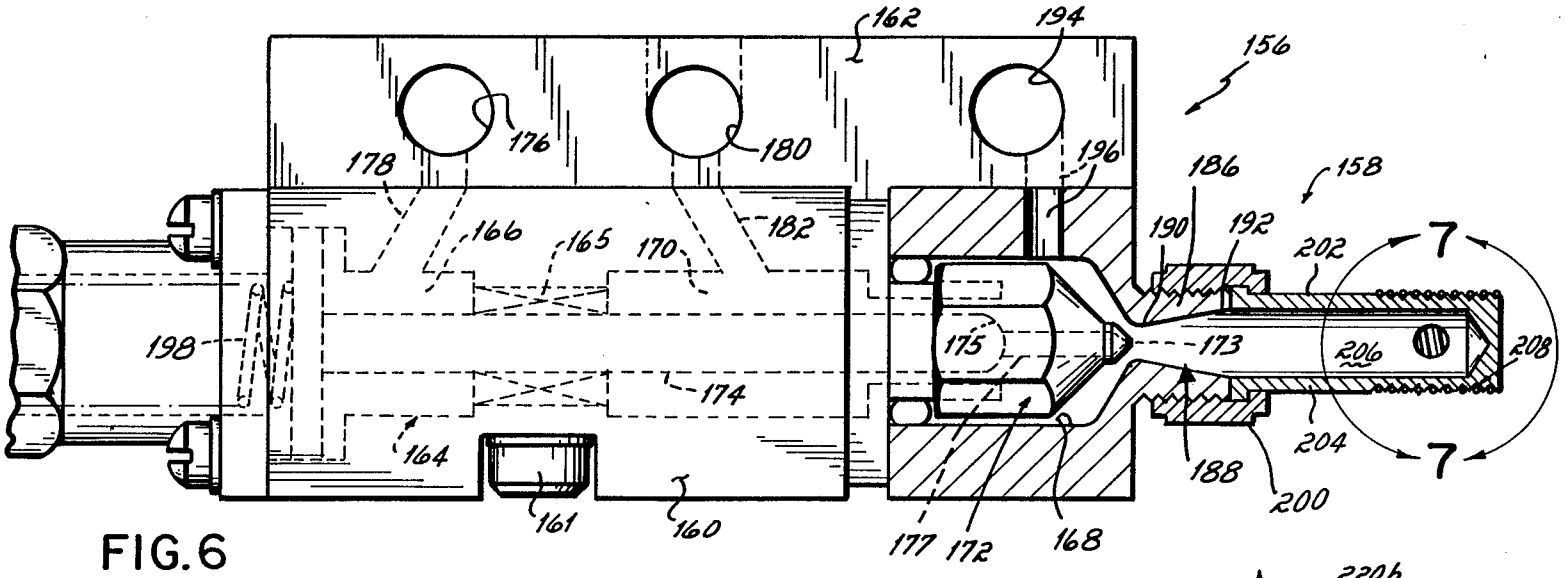
FIG. 6 is an alternative embodiment of the wax spray gun herein in which another embodiment of a spray nozzle is illustrated.

As shown schematically in FIG. 6, the spray gun 156 comprises a gun body 160 mounted by bolts 161 to a manifold 162. The gun body 160 is formed with a central passageway 164 having a pilot air chamber 166 at its rearward end, an atomizing chamber 168 at its forward end and a wax supply chamber 170 intermediate the chambers 166, 168. A seal 165 is interposed between the pilot air chamber 166 and the wax supply chamber 170. An internal nozzle 172 having a discharge outlet 173 is mounted within the atomizing chamber 168, and this internal nozzle 172 is opened and closed by the axial movement of a plunger 174 carried within the central passageway 164 of gun body 160.

Molten wax is recirculated within manifold 162 with the plunger 174 in a closed position in essentially the same manner as described above with reference to the spray gun 10, and as shown in FIG. 2. In order to initiate the flow of molten wax through internal nozzle 172, a valve (not shown) is opened to allow the flow of pilot air from a passage 176 in manifold 162, through a passage 178 in gun body 160 to the pilot air chamber 166. Pressurization of the pilot air chamber 166 moves the plunger 174 rearwardly, or to the left as shown in FIG. 6, thus unseating the plunger tip 175 from the passage 177 in nozzle 172. Molten wax flows from a passage 180 in manifold 162, through a passage 182 in gun body 160 to the wax supply chamber 170. The molten wax continues along the central passageway 164 in gun body 160 into the passage 177 of internal nozzle 172 where it is then ejected from the discharge outlet 173 into the atomizing chamber 168.

The forward end of gun body 160 upstream relative to the internal nozzle 172 is formed with an extension 186. The extension 186 has a passageway 188 formed with a venturi inlet 190 at the exit of atomizing chamber 168, and an outlet 192. Atomizing air is directed into atomizing chamber 168 from a passage 194 in manifold 162, and then through a passage 196 in gun body 160 which tangentially intersects the atomizing chamber 168.

In the same manner as described in detail above with reference to FIGS. 4 and 5, the atomizing air stream entering atomizing chamber 168 is made to flow in a swirling motion around the internal nozzle 172 toward its discharge outlet 173 and into the venturi inlet 190 of extension 186. The venturi inlet 190 of extension 186 is effective to increase the rotational or swirl velocity of the atomizing air stream, as discussed in detail above, so that the atomizing air stream impacts the molten wax ejected from the discharge outlet 173 of the internal nozzle 172 with sufficient force and velocity to thoroughly atomize the molten wax. The atomized molten wax is then ejected from the outlet 192 of extension 186.

The flow of molten wax through spray gun 156 is terminated by shutting off the flow of pilot air and depressurizing pilot air chamber 166 to allow a return spring 198 carried at the rearward end of gun body 160 to force the tip 175 of plunger 174 back into engagement with the passage 177 of internal nozzle 172. In the presently preferred embodiment, the flow of pilot air and atomizing air within manifold 162 is controlled by a programmable controller (not shown) so that the operation of spray gun 156 is essentially automatic.

With reference to the righthand portion of FIG. 6 and FIGS. 7–9, an improved spray nozzle 158 is illustrated which is mounted to the forward end of extension 186 by a cap 200. Although shown with the automatic spray gun 156, it should be understood that nozzle 158 could also be employed with the hand-held spray gun 10 illustrated in FIG. 1.

In the presently preferred embodiment, the nozzle 158 comprises a nozzle body 202 having a cylindrical-shaped wall 204 defining a central passageway 206 for transmitting liquid such as atomized molten wax. It can be seen by reference to FIG. 8 that external threads 208 are formed along a portion of the axial length of wall 204 except for two substantially flat sections 210 and 212 where the external threads 208 are removed. It is contemplated that such flat areas or sections 210, 212 could be formed, for example, by milling the cylindrical-shaped wall 204. Discharge bores 214 and 216 extend through the nozzle wall 204 at the flat sections 210, 212, respectively.

In the presently preferred embodiment, a coil spring 218 is threaded onto the wall 204 of nozzle 202 such that the spring wires 220 of coil spring 218 are carried in the minor diameter portions or valleys 222 of the threads 208 between the major diameter portions or peaks 224 thereof. As a result, the spring wires 220 of coil spring 118 are separated from one another forming a space 226 therebetween.

Figure 9:
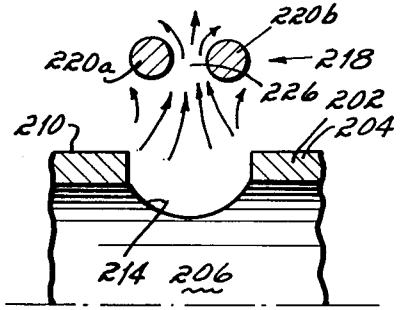
FIG. 9 is a cross sectional view taken generally along lines 9—9 of FIG. 7.
Figure 7:
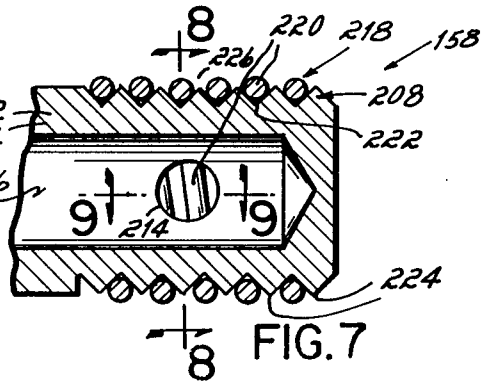
FIG. 7 is an enlarged view of the encircled portion 7—7 of FIG. 6.
Figure 8:
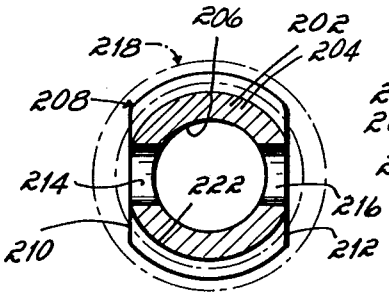
FIG. 8 is a cross sectional view taken generally along lines 8—8 of FIG. 7.

With reference to FIG. 9, at least two spring wires 220*a* and 220*b* are carried in adjacent valleys 222 of threads 208 over the flat sections 210, 212 formed in the nozzle wall 204. In this position, the spring wires 220*a*, 220*b* are positioned in the path of the liquid material, e.g., atomized molten wax, which is ejected from the discharge bores 214, 216 formed in the flat sections 210, 212. The atomized molten wax or other liquid contacts the rounded inner and outer surfaces of the spring wires 220*a*, 220*b* and is discharged from the space 226 therebetween in a substantially diffuse spray pattern. It is believed that the rounded shape of the spring wires 220*a*, 220*b* tends to agitate the atomized molten wax passing therebetween to further enhance atomization of the molten wax prior to deposition onto a surface.

It should be appreciated that the spray characteristics of nozzle 158 could be readily varied by varying the geometry of the external threads 208 and/or the type of coil spring 218 employed. For example, the minor diameter or valleys 222 of the threads 208 could be spaced closer together or further apart to vary the space 226 between adjacent spring wires 220 carried within the valleys 222. Additionally or alternatively, the gauge or diameter of the spring wire 220 of coil spring 218 could be varied as desired.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, in the illustrated embodiment, the nozzle 158 was described as having a wall 204 formed with external threads 208 extending circumferentially therearound. It is contemplated that threads, slots, notches or other recesses could be formed at selected locations along the nozzle wall 204 so long as a coil spring, a length of wire or another cylindrical-shaped element can be held in position on the nozzle wall 204 in the path of liquid discharged from a discharge bore formed in the wall 204. Additionally, the wall 204 of nozzle 158 need not be formed with flat areas or sections 210, 212, and the discharge bores 214, 216 could be formed in an arcuate, cylindrical-shaped area of the nozzle wall 204. Moreover, the number and location of discharge bores 214, 216 formed in the wall 204 can be varied, as desired, to obtain a spray pattern suitable for a given application.

Therefore, it is intended that the invention not be limited to the particular embodiment disclosed as the best mode contemplated for carrying out the invention, but that the invention will include all embodiments falling within the scope of the appended claims.

What is claimed is:

1. Apparatus for spraying an atomized stream of liquid onto a substrate, comprising:

a gun body having an interior formed with a liquid supply passageway, said liquid supply passageway being effective to discharge a stream of liquid within said interior of said gun body;

means for impacting said stream of liquid discharged from said liquid supply passageway with atomizing air to form an atomized stream of liquid within said interior of said gun body;

means for discharging said atomized stream of liquid from said interior of said gun body into an external nozzle assembly located exteriorly of said gun body, said external nozzle assembly including nozzle means for directing said atomized stream of liquid onto a substrate.

2. Apparatus for spraying molten wax onto a substrate comprising:

a gun body formed with a wax supply passageway for transmitting molten wax, and an atomizing chamber;

an internal nozzle connected to said wax supply passageway, said internal nozzle having a discharge outlet for ejecting a stream of molten wax which is located within said atomizing chamber of said gun body;

atomizing means mounted to said gun body, said atomizing means having a passageway formed with an outlet and a venturi inlet, said venturi inlet being located in the path of said stream of molten wax ejected from said discharge outlet of said nozzle;

means for introducing a stream of atomizing air into said atomizing chamber so that said stream of atomizing air is directed in a swirling motion into said venturi inlet of said passageway in said atomizing means, said swirling stream of atomizing air being accelerated in the course of passage through said venturi inlet of said atomizing means and impacting said stream of molten wax ejected from said internal nozzle with sufficient velocity to atomize said stream of molten wax for discharge through said outlet of said atomizing means;

an external nozzle assembly located exteriorly of said gun body, said external nozzle assembly including at least one nozzle means connected to said outlet of said atomizing means for spraying said stream of atomized molten wax onto a substrate.

3. The apparatus of claim 1 in which said atomizing chamber is cylindrical in shape, said means for introducing a stream of atomizing air comprising:

an air valve connected to said gun body and communicating with a supply of atomizing air, said air valve being movable to an open position to transmit atomizing air therethrough;

said gun body being formed with a swirl passageway extending between said air valve and said cylindrical-shaped atomizing chamber, said swirl passageway tangentially intersecting said cylindrical-shaped atomizing chamber to direct pressurized air passing through said air valve in a swirling motion around the wall of said cylindrical-shaped atomizing chamber toward said venturi inlet of said passageway in said atomizing means.

4. The apparatus of claim 3, further including a one-way valve mounted in said swirl passageway between said air valve and said atomizing chamber, said one-way valve being effective to permit the flow of atomizing air into said atomizing chamber and prevent flow in the opposite direction.

5. The apparatus of claim 2 in which said nozzle means comprises:

a nozzle body having a passageway connected to said outlet of said atomizing means for transmitting said stream of atomized molten wax, said nozzle body being formed with a number of apertures intersecting said passageway;

a plurality of spray nozzles carried by said nozzle body, each of said spray nozzles being connected to an aperture in said nozzle body in communication with said passageway for directing said stream of atomized molten wax onto a substrate.

6. The apparatus of claim 2 in which said nozzle means comprises:

a nozzle body having a passageway connected to said outlet of said atomizing means for transmitting said stream of atomized molten wax;

at least one tube carried by said nozzle body and connected to said passageway of said nozzle body for directing said stream of atomized molten wax onto a substrate.

7. A spray nozzle comprising:

a nozzle body having a wall defining a flow passageway for transmitting a stream of fluid, said wall having an outer surface and an inner surface;

said wall of said nozzle body being formed with spaced recesses extending from said outer surface of said wall toward said inner surface thereof, said wall being formed with at least one opening extending therethrough for emitting fluid transmitted by said flow passageway;

deflector means having a first deflector member and a second deflector member, said deflector means being carried on said outer surface of said wall of said nozzle body so that said first and second deflector members are spaced from one another within said spaced recesses in said nozzle body in the path of fluid emitted from said opening in said wall, said fluid contacting said first and second deflector members and being directed through said space therebetween.

8. The spray nozzle of claim 7 in which said spaced recesses are external threads formed on said wall of said nozzle body.

9. The spray nozzle of claim 7 in which said deflector means is a coil spring, and said first and second deflector members are spring wires of said coil spring.

10. A spray nozzle comprising:

a nozzle body having a wall defining a flow passageway for transmitting a stream of fluid, said wall being formed with an inner surface and an outer surface;

said wall of said nozzle body being formed with recesses extending from said outer surface toward said inner surface thereof, said wall being formed with at least one spray opening extending therethrough for emitting fluid transmitted by said flow passageway;

a coil spring having spring wire carried within said recesses formed in said wall of said nozzle body, at least two of said spring wires carried in adjacent recesses being positioned with a space therebetween in the path of fluid emitted from said spray opening in said wall, said fluid contacting said two spring wires and being directed through said space therebetween.

11. A spray nozzle comprising:

a nozzle body having a cylindrical-shaped wall defining a flow passageway for transmitting a liquid material;

said cylindrical-shaped wall of said nozzle body being formed with external threads, said external threads being eliminated in at least one location along said cylindrical-shaped wall to form a spray area, said cylindrical-shaped wall being formed with a spray opening in said spray area for emitting liquid transmitted by said flow passageway;

a coil spring having spring wire carried within said external threads in said wall of said nozzle body, said spring having at least two spring wires carried in adjacent external threads which are spaced from one another and are located in said spray area in the path of liquid emitted from said spray opening, said liquid contacting said spring wires and being directed outwardly from said space therebetween onto a substrate.

12. The spray nozzle of claim 11 in which said spray area is a substantially flat section formed in said cylindrical-shaped wall of said nozzle body.

13. Apparatus for spraying molten wax comprising:

a gun body formed with a wax supply passageway for transmitting molten wax, and an atomizing chamber;

an internal nozzle connected to said wax supply passageway, said nozzle having a discharge orifice for ejecting a stream of molten wax which is located within said atomizing chamber of said gun body;

atomizing means having a passageway formed with an outlet and a venturi inlet, said venturi inlet being located in the path of said stream of molten wax ejecting from said discharge orifice of said nozzle;

means for introducing a stream of atomizing air into said atomizing chamber so that said stream of atomizing air is directed in a swirling motion into said venturi inlet of said passageway in said atomizing means, said swirling stream of atomizing air being accelerated in the course of passage through said venturi inlet of said atomizing means and impacting said stream of molten wax ejected from said nozzle with sufficient velocity to atomize said stream of molten wax for discharge through said outlet of said atomizing means;

an external spray nozzle mounted to said gun body and being connected to said outlet of said atomizing means, said external spray nozzle comprising:

(i) a nozzle body having a cylindrical-shaped wall defining a flow passageway for transmitting said stream of atomized molten wax discharged from said outlet of said atomizing means, said cylindrical-shaped wall of said nozzle body being formed with external threads, said external threads being eliminated in at least one location along said cylindrical-shaped wall to form a spray area, said cylindrical-shaped wall being formed with a spray opening for emitting said stream of atomized molten wax transmitted by said flow passageway;

(ii) a coil spring having spring wire carried within said external threads in said wall of said nozzle body, said coil spring having at least two spring wires carried in adjacent external threads which are spaced from one another and are located in said spray area in the path of said stream of atomized molten wax emitted from said spray opening, said stream of atomized molten wax contacting said spring wires and being directed outwardly from said space therebetween onto a substrate.

14. The method of spraying an atomized stream of liquid onto a substrate, comprising:

impacting a stream of liquid with atomizing air within the interior of a spray device to form an atomized stream of liquid therein;

discharging said atomized stream of liquid from said interior of said spray device into a nozzle assembly including nozzle means nozzle located exteriorly of said spray device;

directing said atomized stream of liquid from said nozzle means onto a substrate.

15. The method of spraying an atomized stream of liquid into a substrate, comprising:

ejecting a stream of liquid into an atomizing chamber formed within the interior of a spray device;

introducing a stream of atomizing air in a swirling motion onto said atomizing chamber;

accelerating said stream of atomizing air through the venturi inlet of a passageway formed at the outlet of said atomizing chamber, said stream of atomizing air impacting said stream of liquid with said swirling motion to atomize said stream of liquid within said spray device;

discharging said atomized stream of liquid from said interior of said spray device into a nozzle assembly including nozzle means located exteriorly of said spray device;

directing said atomized stream of liquid from said nozzle means onto a substrate.

* * * * *